United States Patent [19]

Togoshi

[11] Patent Number: 4,843,859

[45] Date of Patent: Jul. 4, 1989

[54] PIPE BENDER

[75] Inventor: Hideyuki Togoshi, Nishinomiya, Japan

[73] Assignee: Chiyoda Kogyo Co., Ltd., Osaka, Japan

[21] Appl. No.: 73,021

[22] Filed: Jul. 14, 1987

[51] Int. Cl.[4] ..... B21D 7/04

[52] U.S. Cl. ..... 72/149; 72/157

[58] Field of Search ..... 72/149, 150, 155, 157, 72/158, 159, 384, 387

[56] References Cited

U.S. PATENT DOCUMENTS

| | | | |
|---|---|---|---|
| 2,709,473 | 5/1955 | Grace et al. | 72/154 X |
| 4,022,045 | 5/1977 | Riha | 72/128 |
| 4,201,073 | 5/1980 | Eaton | 72/155 |
| 4,313,324 | 2/1982 | Pearson | 72/149 |
| 4,485,658 | 12/1984 | Stewart et al. | 72/149 |

FOREIGN PATENT DOCUMENTS

| | | | |
|---|---|---|---|
| 1962590 | 6/1971 | Fed. Rep. of Germany | 72/157 |

*Primary Examiner*—E. Michael Combs
*Attorney, Agent, or Firm*—Jordan and Hamburg

[57] ABSTRACT

A pipe bender comprising a base block, a pipe feed mechanism mounted on the base block for feeding a pipe longitudinally thereof, and two pipe bending sections mounted on a common support frame connected to the base block to be reciprocable in directions perpendicular to the pipe. The bending sections each include a fixed die assembly and a clamp die assembly. The clamp die assemblies of the respective pipe bending sections are swingable in opposite directions.

1 Claim, 4 Drawing Sheets

PIPE BENDER

BACKGROUND OF THE INVENTION (1) Field of the Invention

The present invention relates to a pipe bender comprising a fixed die assembly and a clamp die assembly for holding a pipe therebetween, the clamp die assembly being swingable about the fixed die assembly within a selectd angular range in timed relation with a pipe feed rate to bend the pipe.

(2) Description of the Prior Art

This type of pipe bender has been proposed and put to extensive practical use in various forms. The known pipe bender comprises only one pipe bending section for one pipe feed mechanism. The pipe bending section includes a clamp die assembly horizontally swingable either clockwise or counterclockwise about a fixed die assembly to bend a pipe held therebetween. After bending the pipe, the clamp die assembly is swung in an opposite direction to return to an original position.

The above known construction has encountered difficulties in bending pipes to certain desired shapes. For example, a bent portion of the pipe contacts the pipe bender, in particular the bending section or a portion of the bender adjacent thereto, thereby obstructing further bending work to be carried out on the pipe. This is due to sizes of radii of curvature at bent positions of the pipe, directions of bend, a distance between two or more bent positions, and so on. Such a situation may make the further bending work impossible.

SUMMARY OF THE INVENTION

Having regard to the state of the art noted above, the object of the present invention is to provide a pipe bender capable of bending a pipe to any desired shape with ease.

In order to achieve this object, a pipe bender according to the present invention comprises a base block, a pipe feed mechanism mounted on the base block for feeding a pipe longitudinally thereof, and two pipe bending sections shiftable relative to the pipe feed mechanism in directions perpendicular to the pipe fed by the pipe feed mechanism. More particularly, the bending sections each include a fixed die assembly and a swingable clamp die assembly, the swingable clamp die assemblies of the respective pipe bending sections being swingable in opposite directions.

The two bending sections, preferably, are mounted on a common support frame connected to the base block to be reciprocable in the directions perpendicular to the pipe fed by the pipe feed mechanism. This construction has the advantage of easiness of pipe bender manufacture and positional control of the pipe bending sections. However, the two bending sections may of course be arranged movable independently of each other. Alternatively, the two bending sections may be fixed to the base block, with the pipe feed mechanism movable relative to the bending sections in the direction perpendicular to the pipe.

Where a pipe is bent at several positions into a selected three-dimensional shape by the movable bending sections, the pipe may be bent at one or more positions by using one of the bending sections to effect rightward bends, and by appropriately rotating the pipe by means of the pipe feed mechanism as necessary. Thereafter the rightward bending mode may become no longer applicable to further bending work because already bent portions of pipe would contact the bender. The bending section heretofore used is then retracted and at the same time the other bending section is moved to a bending position to take over the operation with a leftward bending mode.

The above bending operation may be carried out manually by an operator or automatically by a computerized control system.

It will be understood from the foregoing description that the invention provides a wide range of selection for the shape of bent pipe products. This is convenient for coping with diversifying needs for the bent pipes. Furthermore, at least two pipe benders have been required to bend pipes rightward and leftward into certain shapes but now the invention enables a single machine to carry out this operation efficiently.

Other features and advantages of the present invention will be apparent from the description of the preferred embodiment to follow.

BRIEF DESCRIPTION OF THE DRAWINGS

The drawings illustrate a pipe bender embodying the present invention, in which.

DESCRIPTION OF THE PREFERRED EMBODIMENT

Figure 1:
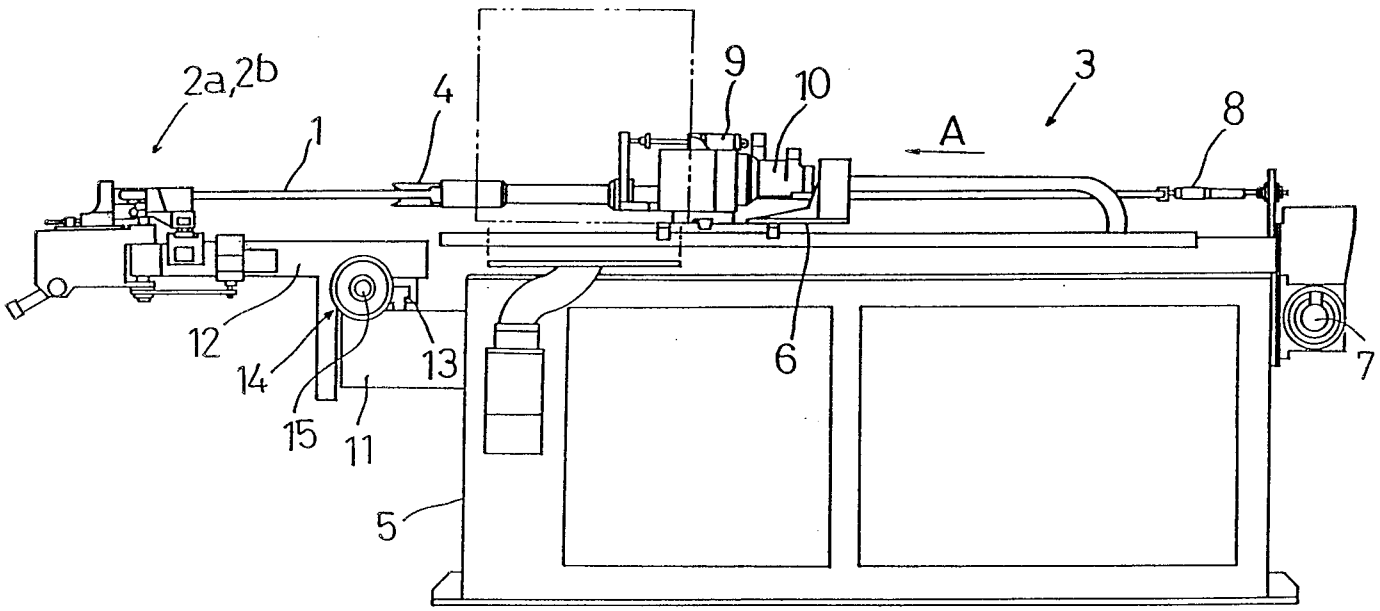
FIG. 1 is a front elevation of the pipe bender.
Figure 2:
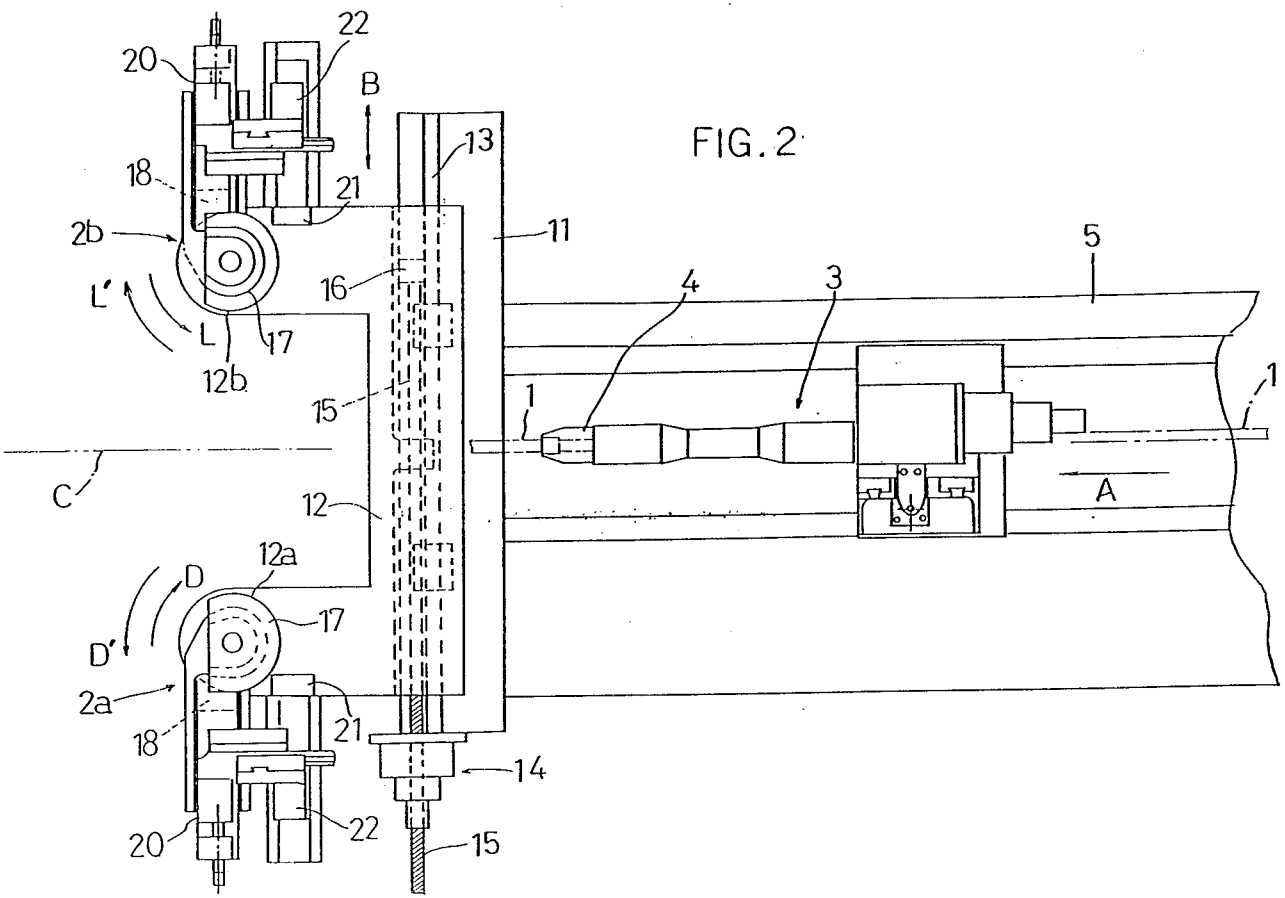
FIG. 2 is a plan view of the pipe bender.

Referring to FIGS. 1 and 2, a pipe bender shown therein comprises a feed mechanism 3 for advancing a pipe 1 in a direction indicated by an arrow A to a first bending section 2*a* or a second bending section 2*b*. The feed mechanism 3 includes a chuck 4 for receiving an end of the pipe 1, and is slidably mounted on a base block 5 by means of a carriage 6 driven by a motor 7. Number 8 indicates a mandrel for receiving the other end of the pipe 1. Number 9 indicates a hydraulic cylinder for opening and closing the chuck 4. Number 10 indicates a servomotor for rotating the chuck 4 about the axis of the pipe 1.

The base block 5 includes a projection 11 extending toward the first and second bending sections 2*a* and 2*b*. The projection 11 supports a frame 12 mounted thereon to be slidable along a guide rail 13 extending on the projection 11 in a direction indicated by an arrow B in FIG. 2 which is perpendicular to the pipe feeding direction A. The frame 12 acts as common support for the first and second bending sections 2*a* and 2*b*. A ball screw mechanism 14 includes a screw shaft 15 reciprocable in the direction B and having an end 16 thereof fixed to the frame 12.

The first bending section 2*a* which is for bending the pipe 1 rightward and the second bending section 2*b* for bending the pipe 1 leftward will be described in detail next with reference to FIGS. 2 and 3. The two bending sections 2*a* and 2*b* are symmetric, i.e. one being a mirror image of the other, about a vertical plane C extending along a centerline of the pipe bender. Each of the bending sections 2*a* and 2*b* includes a fixed die assembly 17 and a swingable clamp die assembly 18. The fixed die assembly 17 includes three dies 17*a*, 17*b* and 17*c* arranged vertically and having different diameters. The swingable clamp die assembly 18 also includes three dies 18*a*, 18*b* and 18*c* arranged vertically and having different radii of curvature. The pipe 1 is bent as held between the dies 17*a* and 18*a*, the dies 17*b* and 18*b* or the dies 17*c* and 18*c*. Each bending section 2*a* or 2*b* further includes a hydraulic cylinder 19 for vertically shifting the fixed die assembly 17 and the swingable clamp die assembly 18, and a mechanism 20 for reciprocating the swingable clamp die assembly 18 in directions indicated by an arrow B in FIG. 3 between a position to grip the pipe 1 and a position to release the pipe 1. As seen in FIG. 2, this mechanism 20 comprises a hydraulic cylinder.

The swingable clamp die assembly 18 is swingable back and forth about the fixed die assembly 17 by a mechanism mounted in a projection 12*a* or 12*b* of the frame 12 and acting also as bearing for the fixed die assembly 17. A pressure die 21 is disposed adjacent the swingable clamp die assembly 18 to support the pipe 1 at a position short of a bending position of the pipe 1. The pressure die 21 is reciprocable by a mechanism 22 and swingable with the swingable clamp die assembly 18.

How to use this pipe bender will be described next. For bending the pipe 1 rightward, the ball screw mechanism 14 is operated to shift the frame 12 upward in FIG. 2, that is leftward in FIG. 3, whereby the pipe 1 is held between the fixed die assembly 17 and clamp die assembly 18 of the first bending section 2*a*. Then the clamp die assembly 18 and the pressure die 21 are swung clockwise as indicated by an arrow D in FIGS. 2 and 5. After the pipe 1 is bent, the clamp die assembly 18 is separated from the fixed die assembly 17 and is returned to the original position as indicated by an arrow D'.

Figure 6:
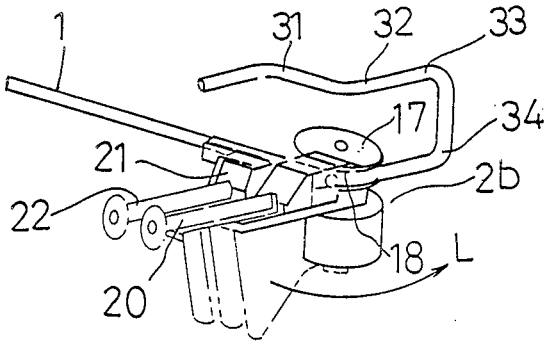
FIG. 6 is a perspective view of a second bending section in action.

For bending the pipe 1 leftward, the second bending section 2*b* is used and its clamp die assembly 18 and pressure die 18 are swung counterclockwise as indicated by an arrow L in FIGS. 2 and 6. After the pipe 1 is bent, the clamp die assembly 18 and pressure die 18 are returned to the original position as indicated by an arrow L'.

Figure 4:
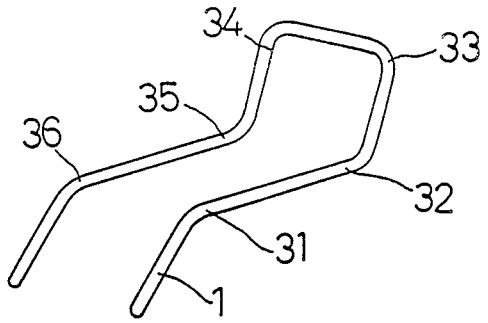
FIG. 4 is a perspective view of an example of product shaped by using the pipe bender of this invention.
Figure 5:
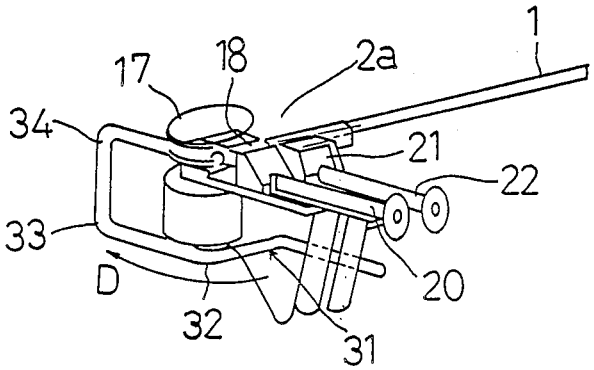
FIG. 5 is a perspective view of a first bending section in action.

Finally, a specific example of bending operation will be described referring to FIGS. 4 through 6. It is assumed that a product as shown in FIG. 4 is manufactured by bending the pipe 1 at six positions 31–36. The pipe 1 may be bent at positions 31–34 by using the first bending section 2a to effect rightward bends, and by appropriately rotating the pipe 1 by means of the chuck 4 and thervomotor 10 as necessary. However, the rightward bending mode is no longer applicable to the position 35 of pipe 1, since already bent portions of pipe 1 forwardly of this position 35 would contact the bender as shown in FIG. 5. In this case, the frame 12 is moved to switch for the leftward bending mode utilizing the second bending section 2b to form further bends on the pipe 1. This enables the pipe 1 ultimately to have a shape as shown in FIG. 4.

Figure 3:
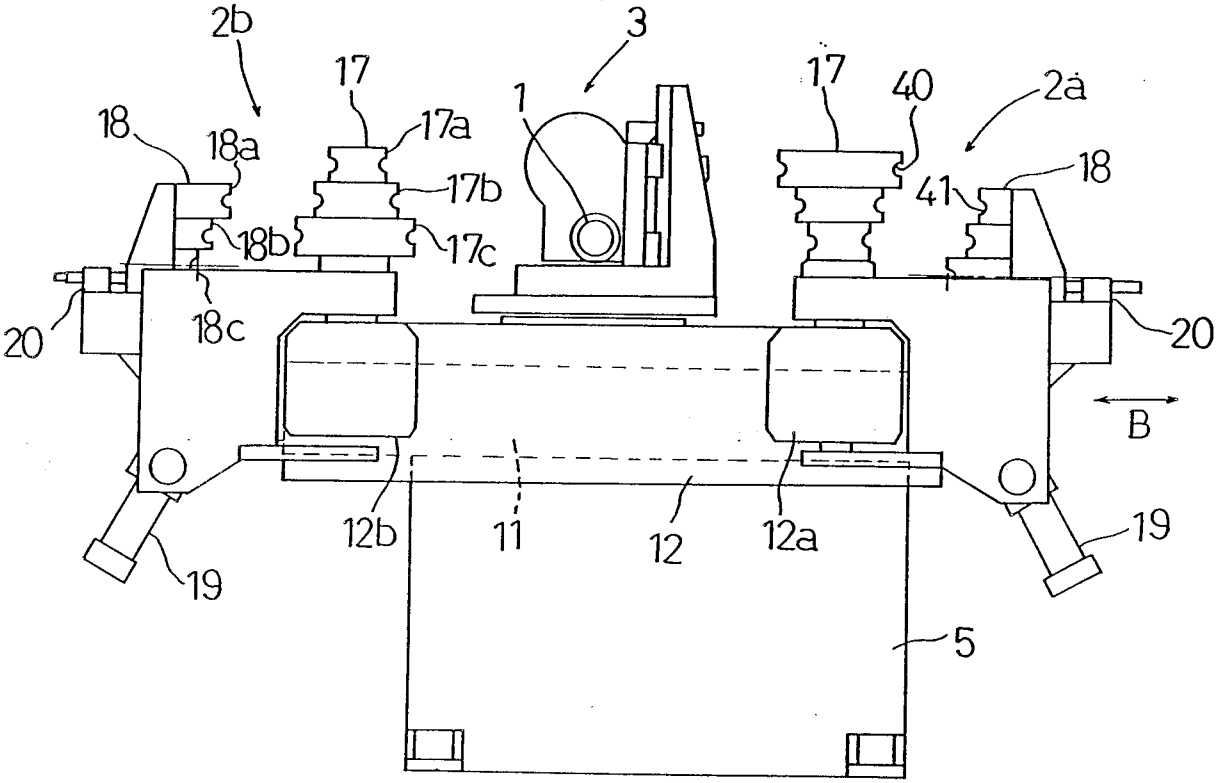
FIG. 3 is a side view of the pipe bender.

The bender may have plural types of fixed die assemblies and swingable clamp die assemblies ready for use, which includes dies with recesses different in dimension from recesses 40, 41 of the dies 17*a*–17*c* and 18*a*–18*c* in FIG. 3. Then the bender is capable of bending pipes of different diameters and a pipe having diameters varying longitudinally thereof as well, by interchanging these die assemblies for mounting in the first and second bending sections.

The described pipe bender may of course be used for bending a length of solid rod.

What is claimed is:

1. A pipe bender comprising a base block, pipe feed means mounted on the base block for feeding a pipe longitudinally thereof along a first predetermined axis, and two pipe bending sections, each of said bending sections being mounted for movement relative to the pipe feed means in a first plane perpendicular to said first predetermined axis, wherein the two pipe bending sections are separately mounted on opposite ends of a common support frame, said common support frame being moveably mounted on the base block for reciprocation along a second axis in a second plane which is perpendicular to said first plane, the two pipe bending sections each including a fixed die assembly and a swingable clamp die assembly, the swingable clamp die assemblies of the respective pipe bending sections being swingable in opposite directions.

* * * * *